US006588331B2

(12) United States Patent
Thibodeau

(10) Patent No.: US 6,588,331 B2
(45) Date of Patent: Jul. 8, 2003

(54) SCREW PRESS INLET SECTION

(75) Inventor: Pierre Thibodeau, Montréal-Nord (CA)

(73) Assignee: Voith Paper Inc., Appleton, WI (US)

( * ) Notice: Subject to any disclaimer, the term of this patent is extended or adjusted under 35 U.S.C. 154(b) by 167 days.

(21) Appl. No.: 09/741,299

(22) Filed: Dec. 19, 2000

(65) Prior Publication Data

US 2002/0050214 A1 May 2, 2002

(51) Int. Cl.[7] ..... B30B 9/12

(52) U.S. Cl. ..... 100/112; 100/110; 100/117; 100/126; 100/127; 100/145

(58) Field of Search ..... 100/112, 117, 100/127, 145, 110, 126

(56) References Cited

U.S. PATENT DOCUMENTS 3,688,687 A * 9/1972 Craig et al. ..... 100/117
4,363,264 A * 12/1982 Lang et al. ..... 100/117
4,838,995 A * 6/1989 Klausen ..... 162/18
5,409,541 A * 4/1995 Walker ..... 100/117
5,476,550 A * 12/1995 Walker ..... 100/117
5,567,463 A * 10/1996 Schaaf ..... 366/87

* cited by examiner

*Primary Examiner*—William Hong
(74) *Attorney, Agent, or Firm*—Akerman Senterfitt

(57) ABSTRACT

A screw press inlet section comprises a housing defining a radial inlet opening leading to an axially extending chamber through which a screw is rotatably mounted for conveying and dewatering a solid-liquid mixture fed into the chamber through the inlet opening. The housing has an end wall extending in a plane normal to the screw and to which a perforated plate is integrated to provide the additional surface available for drainage at the inlet section. A pulsator is provided within the housing to generate hydraulic pulses against the perforated plate so as to prevent plugging thereof.

18 Claims, 4 Drawing Sheets

SCREW PRESS INLET SECTION

BACKGROUND OF THE INVENTION

1. Field of the Invention

The present invention relates to a screw press for extracting liquids from solid-liquid mixtures and, more particularly, addresses the issue of hydraulic capacity of a screw press inlet section.

2. Description of the Prior Art

It is widely known to use a screw press to extract liquids from a solid-liquid mixture, such as a pulp suspension.

Conventional screw presses typically include a perforated cylinder having axially spaced-apart inlet and outlet ends, and a screw rotatable within the perforated cylinder to compress and dewater a solid-liquid mixture as it is conveyed thereby from the inlet end to the outlet end of the perforated cylinder. The liquid is forced to drain across a perforated cylindrical screen surface extending axially between the inlet and outlet ends of the housing.

Although such conventional screw presses are effective, it has been found that it would be beneficial to improve the drainage capacities of the inlet end thereof and, thus, lift the restriction on the total admittable feed flow to the presses.

SUMMARY OF THE INVENTION

It is therefore an aim of the present invention to improve the dewatering performances in an inlet area of a screw press.

It is also an aim of the present invention to increase the surface available for drainage at an inlet end of a screw press.

Therefore, in accordance with the present invention, there is provided a screw press inlet section comprising a housing defining an axially extending chamber having a longitudinal axis and a radial inlet opening for receiving an incoming solid-liquid mixture. The chamber has an outboard end wall defining a plurality of liquid flow passages for allowing the same to act as a drainage surface.

In accordance with a further general aspect of the present invention, there is provided a screw press for extracting liquids from a solid-liquid mixture, comprising a housing having longitudinally spaced-apart inlet and outlet sections, and a pressing section between said inlet and outlet sections. A rotatable feed and compression screw is mounted within said housing for conveying the solid-liquid mixture from the inlet section to the outlet section while compressing and dewatering the liquid-solid mixture such that liquid is discharged from said housing. The inlet section has an outboard end wall defining a plurality of liquid flow passages for liquid to drain therethrough in a direction opposite to a general traveling direction of the solid-liquid mixture within the screw press.

BRIEF DESCRIPTION OF THE DRAWINGS

Having thus generally described the nature of the invention, reference will now be made to the accompanying drawings, showing by way of illustration a preferred embodiment thereof, and in which.

DESCRIPTION OF THE PREFERRED EMBODIMENTS

Figure 1:
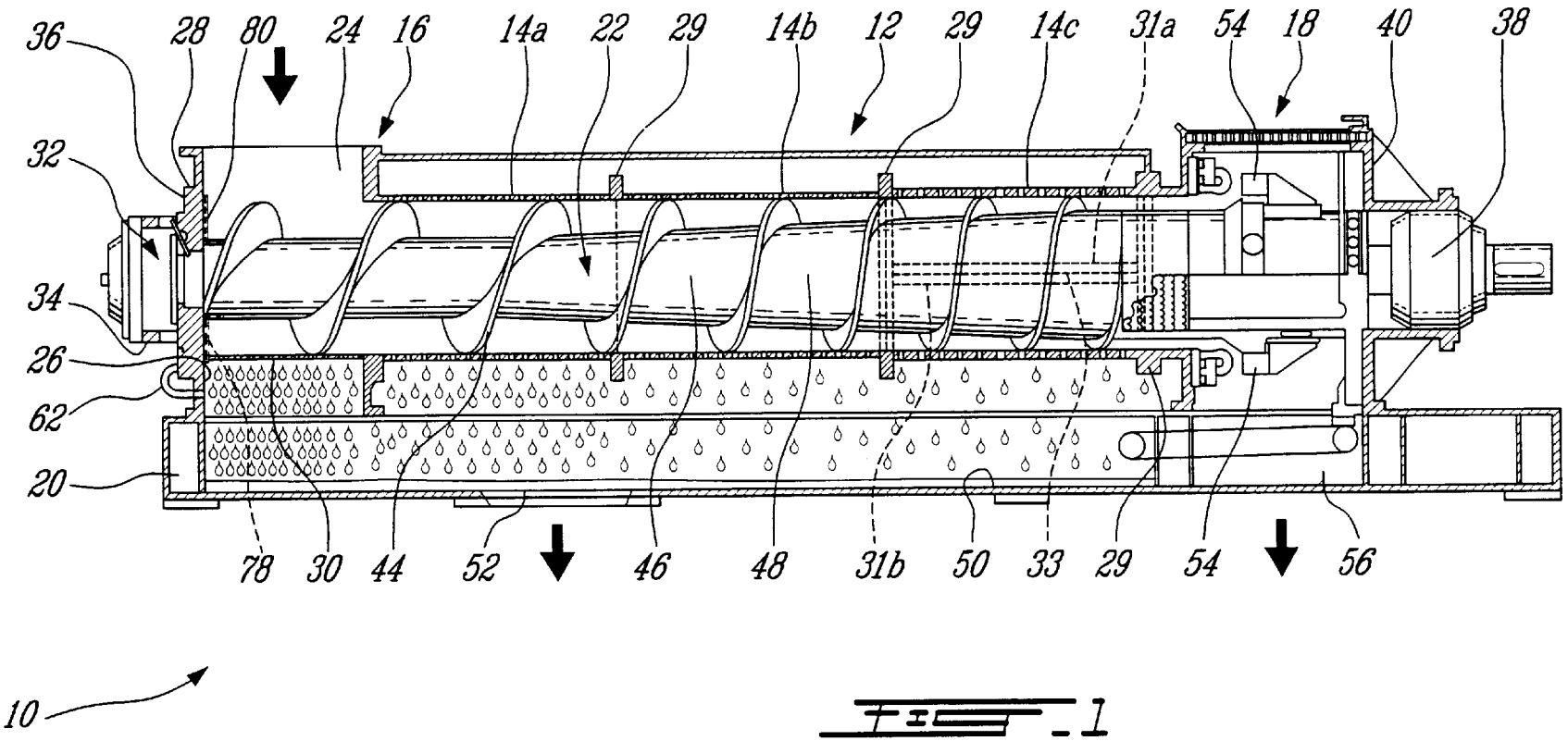
FIG. 1 is a longitudinal cross-sectional view of a screw press in accordance with a first embodiment of the present invention.

Now referring to the drawings, and in particular to FIG. 1, a screw press embodying the elements of the present invention and generally designated by numeral 10 will be described.

The screw press 10 generally includes an intermediate pressing section 12 including a number of cylindrical screens 14*a,* 14*b* and 14*c* mounted in an end-to-end relationship and supported between axially spaced-apart inlet and outlet housing sections 16 and 18, which are, in turn, mounted on a rigid base frame 20. The inlet housing section 16, the intermediate pressing section 12 and the outlet housing section 18 form an elongated cylindrical cage or housing concentrically surrounding a rotatable screw member 22 operable to compress and dewater a solid-liquid mixture, such as a light consistency cellulosic pulp suspension, as the same is conveyed thereby from the inlet housing section 16 to the outlet housing section 18.

The solid-liquid mixture is fed to the screw press 10 through a radial inlet opening 24 defined in a top surface of the inlet housing 16. The inlet opening 24 starts axially at the beginning of the screw member 22, that is, next to an inner surface 26 of an outboard end wall 28 of the inlet housing section 16 and extends over an appropriate length of the screw member 22 to ensure proper distribution of the incoming solid-liquid mixture in the inlet housing section 16.

The inlet housing section 16 is provided with a bottom semi-cylindrical screen plate 30 extending axially in continuity with the cylindrical screens 14*a,* 14*b* and 14*c* to form therewith a uniform drainage surface for the solid-liquid mixture to be processed. The semi-cylindrical screen plate 30 is typically made of a screen plate shaped into a half cylinder and is welded into a lower portion of the inlet housing section 16. The cylindrical screens 14*a,* 14*b* and 14*c* are typically each made of a thick stainless steel plate that is rolled into a cylinder, and seam welded. The axially opposed ends of the cylindrical screens 14*a,* 14*b* and 14*c* are provided with flange connections 29 for allowing the same to be removably connected together and supported between the inlet and outlet housing sections 16 and 18. The cylindrical screen 14*c* is provided in the form of two halves 31*a* and 31*b* interconnected along respective longitudinal lateral flanges 33.

The screw member 22 is supported at an inlet end thereof by a heavy duty spherical roller bearing 32 mounted within a supporting fixture 34 secured to an outer surface 36 of the outboard end wall 28 of the inlet housing section 16. Likewise, the screw member 22 is supported at an outlet end thereof by an outlet bearing 38 mounted to an end wall 40 of the outlet housing section 18. The outlet end of the screw member 22 is drivingly connected to a coaxial drive shaft (not shown).

The screw member 22 has a continuous flight 44 extending helically around a smooth outer surface 46 of a screw shaft core 48 from an inlet end thereof to a location generally corresponding to a downstream end of the cylindrical screen 14*c* of the intermediate pressing section 12. The diameter of the outer smooth surface 46 of the screw shaft core 48 gradually increases in a direction from the inlet housing section 16 to the outlet housing section 18, while the pitch of the screw flight 44 gradually decreases in that same direction. As a result, the volume between adjacent turns of screw flight 44 and the cylindrical screens 14*a,* 14*b* and 14*c* decreases progressively towards the outlet end of the screw member 22, thereby gradually increasing the pressure on the solid-liquid mixture so as to force liquid to drain through the drainage surface formed by the semi-cylindrical screen plate 30, and the cylindrical screens 14*a,* 14*b* and 14*c.* The screen holes in the semi-cylindrical screen plate 30, and the cylindrical screens 14*a,* 14*b* and 14*c* are preferably conical with the smaller openings on the inner side of the screen plate 30 and of the cylindrical screens 14*a,* 14*b* and 14*c* to prevent accumulation of fibers and plugging of the screen holes. The liquid draining off through the semi-cylindrical screen plate 30 and the cylindrical cylinders 14*a,* 14*b* and 14*c* is collected in a trough 50 defined in the base frame 20 and drained off from there to an appropriate location via a drain 52.

The axial portion of the screw member 22 which extends through the outlet housing section 18 has shredder arms 54 for breaking up the separated solid phase of the processed material, which could be in the form of a cake, before the same is discharged from the screw press 10 through a radial discharge opening 56 defined in a bottom surface of the outlet housing section 18.

In contrast to conventional screw press inlet sections which are provided with a solid non-perforated impermeable end wall, the outboard end wall 28 of the inlet housing section 16 includes a perforated plate 58 in the form of an annular disc mounted about the screw member 22 upstream of the helical screw flight 44 thereof. The perforated plate 58 provides extra drainage surface at the inlet end of the press screw 10, thereby advantageously increasing production capacity by increasing the total admittable feed flow to the press, reducing feed pressure for a same flow as compared to a conventional screw press, and allowing for increased consistency of the dewatered material at the outlet housing section 18.

Figure 2:
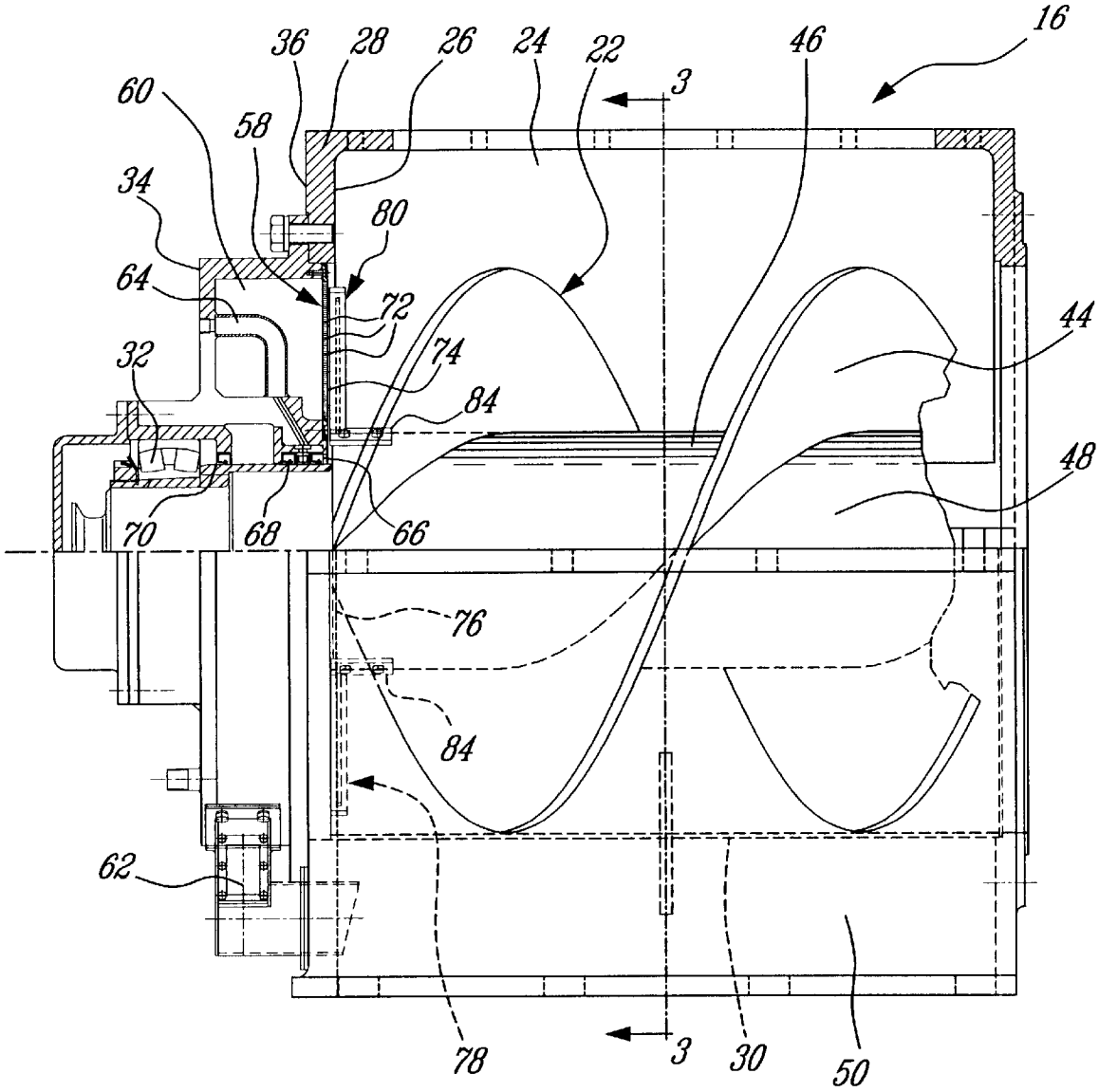
FIG. 2 is an enlarged cross-sectional view of an inlet section of the screw press illustrated in FIG. 1.
Figure 3:
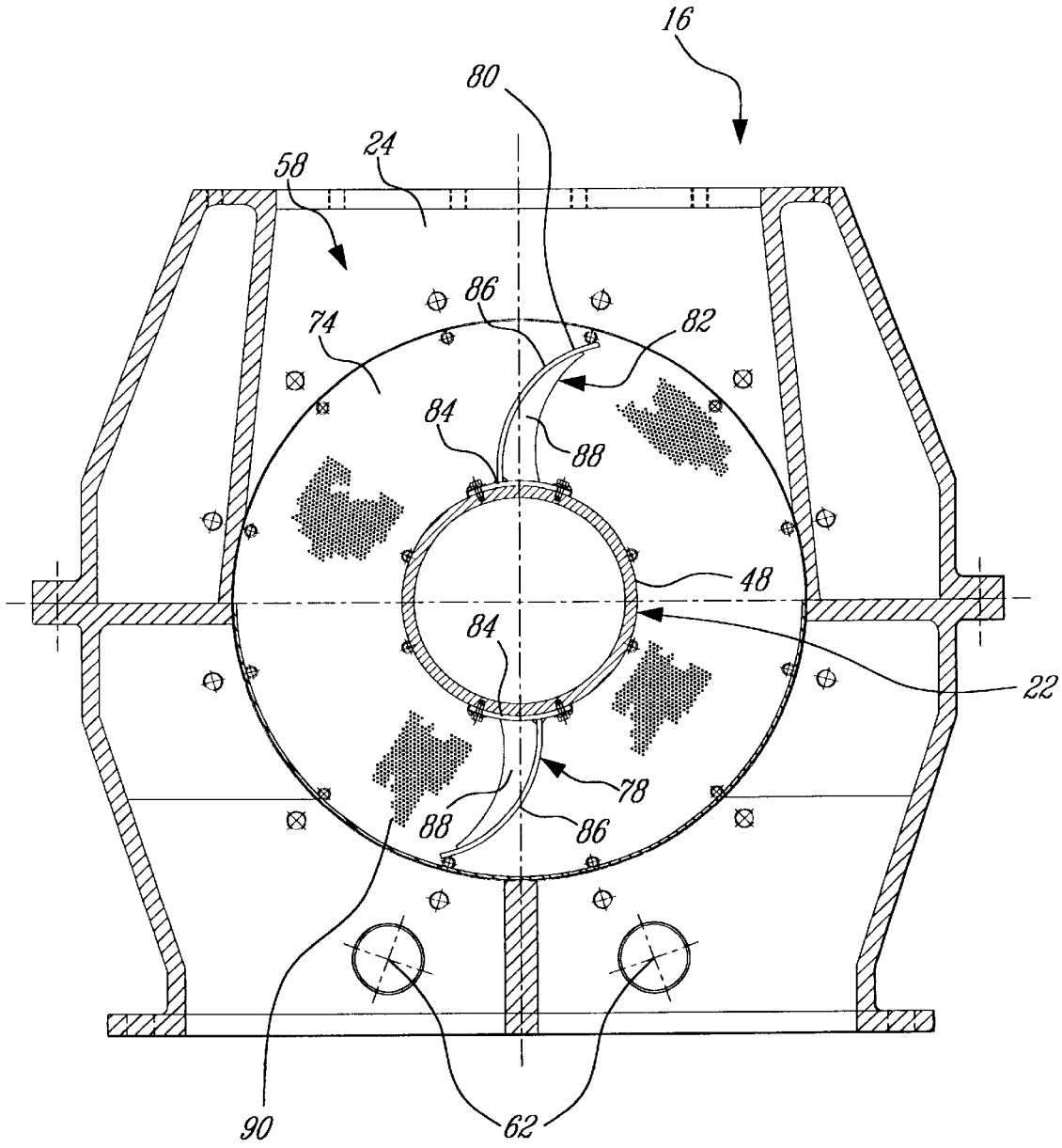
FIG. 3 is a cross-sectional view taken along line 3—3 in FIG. 2.

As shown in FIGS. 2 and 3, the perforated plate 58 is secured to the supporting fixture 34 housing the bearing 32. The supporting fixture 34 defines an annular chamber 60 for receiving the liquid drained across the perforated plate 58. The liquid received into the annular chamber 60 is directed back to the screw press drain 52 via an evacuation pipe assembly 62 provided at the bottom of the annular chamber 60.

As shown in FIG. 2, a water passage 64 extends through the supporting fixture 34 to direct a jet of water from a source of pressurized water (not shown) to a location comprised between a pair of axially spaced-apart annular seals 66 and 68 mounted about the screw shaft core 48. The jet of water and the annular seals 66 and 68 cooperate to prevent the liquid flowing into the inlet housing section 16 from flowing to the bearing 32. A third annular seal 70 is mounted about the screw shaft core 48 adjacent the bearing 32 as an additional liquid barrier.

The perforated plate 58 includes a plurality of round holes 72 distributed thereon between a pair of imaginary concentric circles extending around the screw shaft core 48. The last row of holes is provided on the outer circle which has a diameter which is slightly less than that of the imaginary envelope described by the screw flight 44 when the screw member 22 is rotated. The holes 72 are step drilled with the nominal size perforations executed on an inner side 74 of the plate 58. The holes 72 are then enlarged (using the existing holes as a pilot) from an outer side 76 of the plate 58 but stop short of the inner side 74 thereof such that a short length (about a third of the original depth) of the nominal size of the hole remains. The resulting hole geometry prevents blocking and ensures positive flow from the inner side 74 of the perforated plate 58.

It is contemplated to manufacture the screen plate 58 with either one of the following open areas: 17.3%, 22.7%, 27.5% or 28.8%. However, other specs could be used as well. Also, the round perforations or holes 72 in the screen plate 58 could be replaced by slots.

As shown in FIGS. 2 and 3, a pair of diametrically opposed baffles 78 and 80 can be securely mounted to the screw shaft core 48 in front of the perforated plate 58 to keep the incoming solid-liquid mixture from building up on the screen plate 58 by creating gentle hydraulic pulses as the screw member 22 rotates. Therefore, the baffles 78 and 80 act as a pulsator to direct waves of incoming material against the screen plate 58, thereby preventing the holes 72 from becoming plugged which would obviously impede the dewatering action of the screen plate 58. The baffles 78 and 80 are particularly useful in the case of pulp suspension.

The strength of the hydraulic pulses generated by the rotation of the baffles 78 and 80 can be adjusted by letting the baffles 78 and 80 come more or less in proximity of the inner surface 74 of the screen plate 58. Satisfactory results have been obtained by positioning the baffles 78 and 80 at a distance of 0 to 2 mm away from the inner surface 74 of the screen plate 58.

As shown in FIGS. 2 and 3, each baffle 78 and 80 is provided in the form of a fin 82 extending outwardly from one end of a curved base 84 adapted to be secured to the smooth outer surface 46 of the screw shaft core 48, such as by bolting. The fin 82 includes a curved rib 86 and a fin-shaped web 88 extending centrally from a concave trailing side 90 of the curved rib 86.

Figure 4:
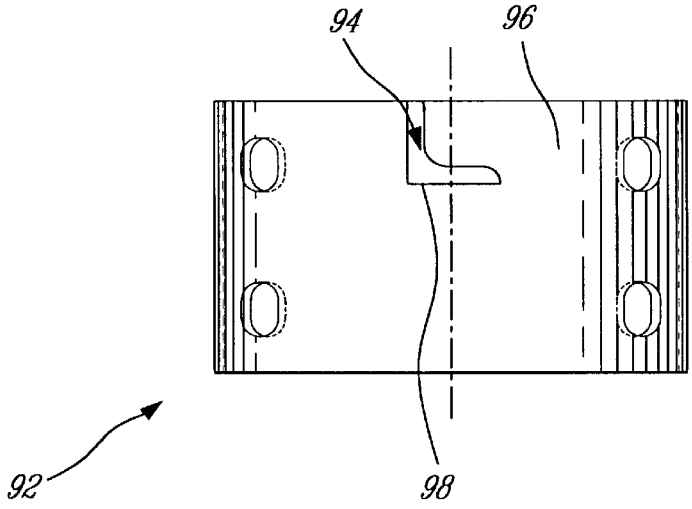
FIG. 4 is a top plan view of a baffle in accordance with a second embodiment of the present invention.
Figure 5:
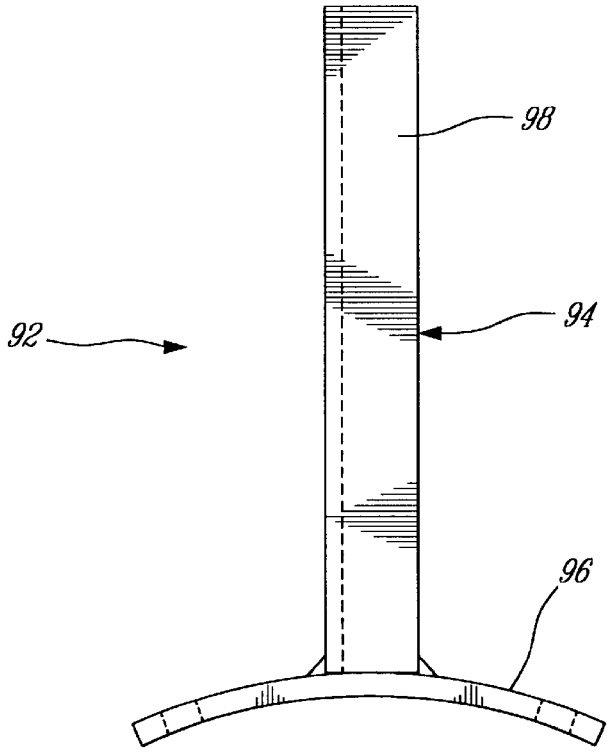
FIG. 5 is front elevational view of the baffle illustrated in FIG. 4.

FIGS. 4 and 5 show another possible construction of a baffle 92. The baffle 92 includes a straight L-shaped blade 94 extending from a curved base 96 adapted to be bolted to the screw shaft core 48. The baffle 92 is secured to the screw shaft core 48 with blade surface 98 facing the screen plate 58.

It is noted that the number of baffles required to prevent plugging of the screen plate 58 can vary depending on the substance to be processed. In some instances, the action of the screw flight 44 can be sufficient and, thus, no baffle needs to be added to the screw member 22.

It is also pointed out that the baffles 78, 80 and 92 do not necessarily have to be mounted to the screw shaft core 48 but could rather form part of another rotating structure mounted within the inlet housing section 16.

What is claimed:

1. A screw press inlet section comprising:

a housing defining an axially extending chamber having a longitudinal axis and a radial inlet opening for receiving an incoming solid-liquid mixture, said chamber having an outboard end wall;

wherein said outboard end wall defines a plurality of liquid flow passages for allowing said outboard end wall to act as a drainage surface, and wherein a plurality of spaced-apart pulsators is provided within said chamber adjacent said outboard end wall for creating hydraulic pulses against said outboard end wall by repeatedly directing waves of incoming material thereagainst.

2. A screw press inlet section as defined in claim 1, wherein said radial inlet opening is located adjacent to said outboard end wall.

3. A screw press inlet section as defined in claim 1, wherein said pulsators include at least two baffles rotatably mounted within said chamber in front of said outboard end wall for rotation about said longitudinal axis, said baffles being raked relative to said outboard end wall.

4. A screw press inlet section as defined in claim 3, wherein said baffles are adapted to be securely mounted to an inlet end of a rotatable feed and compression screw.

5. A screw press inlet section as defined in claim 3, wherein said baffles have a fin-shaped blade portion.

6. A screw press inlet section as defined in claim 4, wherein said baffles include a pair of diametrically opposed baffles.

7. A screw press inlet section as defined in claim 1, wherein said outboard end wall includes a perforated plate adapted to be mounted about a rotatable feed and compression screw.

8. A screw press inlet section as defined in claim 7, further including a bearing housing mounted to an outer surface of said outboard end wall, said bearing housing defining a fluid collecting chamber for receiving liquid draining through said perforated plate.

9. A screw press inlet section as defined in claim 7, wherein said perforated plate is provided in the form of a disc in which said plurality of liquid flow passages are distributed.

10. A screw press for extracting liquids from a solid-liquid mixture, comprising:

a housing having longitudinally spaced-apart inlet and outlet sections, and a pressing section between said inlet and outlet sections; and a rotatable feed and compression screw mounted within said housing for conveying the solid-liquid mixture from the inlet section to the outlet section while compressing and dewatering the liquid-solid mixture such that liquid is discharged from said housing, wherein said inlet section has an outboard end wall, said outboard end wall defining a plurality of liquid flow passages for liquid to drain therethrough in a direction opposite to a general traveling direction of the solid-liquid mixture within said screw press, wherein a set of pulsators is provided adjacent said outboard end wall for directing waves of in incoming material against said outboard end wall.

11. A screw press as defined in claim 10, wherein said feed and compression screw extends perpendicularly through said outboard end wall, and wherein said liquid flow passages are distributed about said feed and compression screw.

12. A screw press inlet section as defined in claim 11, wherein said inlet section defines a radial inlet opening which is located adjacent to said outboard end wall.

13. A screw press as defined in claim 10, wherein said set of pulsators includes at least one baffle rotatably mounted within said housing in front of said outboard end wall for rotation about said longitudinal axis.

14. A screw press as defined in claim 13, wherein said at least one baffle has a fin-shaped blade portion.

15. A screw press as defined in claim 13, wherein said at least one baffle is securely mounted to said rotatable feed and compression screw.

16. A screw press as defined in claim 10, wherein said outboard end wall includes a perforated plate adapted to be mounted about said rotatable feed and compression screw.

17. A screw press as defined in claim 16, further including a bearing housing mounted to an outer surface of said outboard end wall, said bearing housing defining a fluid collecting chamber for receiving liquid draining through said perforated plate.

18. A screw press as defined in claim 17, wherein said perforated plate is provided in the form of a disc in which said plurality of liquid flow passages are distributed.

* * * * *

UNITED STATES PATENT AND TRADEMARK OFFICE

CERTIFICATE OF CORRECTION

PATENT NO. : 6,588,331 B2
DATED : July 8, 2003
INVENTOR(S) : Thibodeau

It is certified that error appears in the above-identified patent and that said Letters Patent is hereby corrected as shown below:

Column 6,
Line 9, delete the word "in".

Signed and Sealed this

Twenty-second Day of November, 2005

JON W. DUDAS
*Director of the United States Patent and Trademark Office*